US006563033B1

(12) United States Patent
Porzilli

(10) Patent No.: US 6,563,033 B1
(45) Date of Patent: May 13, 2003

(54) STRINGED MUSICAL INSTRUMENT WITH APPARATUS ENHANCING LOW FREQUENCY SOUNDS

(76) Inventor: Louis B. Porzilli, 164 W. Shore Trail, Sparta, NJ (US) 07871

( * ) Notice: Subject to any disclaimer, the term of this patent is extended or adjusted under 35 U.S.C. 154(b) by 697 days.

(21) Appl. No.: 09/002,058

(22) Filed: Dec. 31, 1997

Related U.S. Application Data

(60) Provisional application No. 60/034,635, filed on Jan. 3, 1997.

(51) Int. Cl.[7] ..... G10D 3/02

(52) U.S. Cl. ..... 84/294; 84/291; 84/270; 84/267; 84/275; 84/269

(58) Field of Search ..... 84/270, 271, 275, 84/189, 276, 277, 294, 295, 296, 267, 269, 291; 181/171, 172; D17/14, 15, 16, 17, 18, 19

(56) References Cited

U.S. PATENT DOCUMENTS

| | | | | | |
|---|---|---|---|---|---|
| 766,049 | A | * | 6/1904 | Loppentien | 84/270 |
| 1,090,261 | A | * | 3/1914 | Weiser | 84/189 |
| D45,566 | S | * | 4/1914 | Longobardi | D17/14 |
| 1,289,590 | A | * | 12/1918 | Young | 84/270 |
| 1,303,466 | A | * | 5/1919 | Dunham | 84/270 |
| 1,335,010 | A | * | 3/1920 | Morris | 84/267 |
| 1,355,977 | A | * | 10/1920 | Irwin et al. | 84/270 |
| 1,455,916 | A | * | 5/1923 | Kalaf, Jr. | 84/270 |
| 1,530,984 | A | * | 3/1925 | Crippen | 84/189 |
| 1,635,502 | A | * | 7/1927 | Redlinger | 84/270 |
| 1,679,290 | A | * | 7/1928 | Bessier | 84/189 |
| 1,721,710 | A | * | 7/1929 | Pedersen | 84/267 |
| 1,741,453 | A | * | 12/1929 | Dopyera | 84/270 |
| 2,089,629 | A | * | 8/1937 | Stowe | 84/294 |
| 2,800,051 | A | * | 7/1957 | Arlington | 84/276 |
| 2,953,052 | A | * | 9/1960 | Newton | 84/1.16 |
| 3,101,810 | A | * | 8/1963 | Doschek | 181/31 |
| 3,314,324 | A | * | 4/1967 | Williams | 84/294 |
| 3,524,377 | A | * | 8/1970 | Desmond | 84/267 |
| D219,354 | S | * | 12/1970 | Pelensky | D56/1 |
| D239,975 | S | * | 5/1976 | Pelensky | D56/1 A |
| 4,079,654 | A | * | 3/1978 | Kasha | 84/291 |
| 4,773,295 | A | * | 9/1988 | Visser | 84/276 |
| 4,881,617 | A | * | 11/1989 | Faraone | 181/164 |
| 5,780,758 | A | * | 7/1998 | McGill | 84/296 |

FOREIGN PATENT DOCUMENTS

| | | | |
|---|---|---|---|
| DE | 4122750 | * | 1/1993 |
| FR | 370137 | * | 1/1907 |
| GB | 440271 | * | 12/1935 |

* cited by examiner

*Primary Examiner*—Shih-Yung Hsieh

(57) ABSTRACT

A stringed instrument such as a guitar with a thinner than traditional body is provided enhanced decibels measured by sound pressure level (DBSPL) response employing a combination of one or more of each of a passive radiator, tuned isolated resonating wave guide or guides in the body cavity and an equalized closeable sound opening in the front face configured to maximize volume at low frequencies and increasing low frequency response, e.g., at or less than 500 Hz. The passive radiator may be in either the front or rear or both faces. The wave guides each comprise elongated sheets in the body chamber spaced from the corresponding face by spaced posts. The wave guides may be in opposing cooperating pairs or may be staggered for directing low frequency waves to a sound opening in the front face and resonate to provide enhanced low frequency response and subsequent volume. The passive radiator in the rear face is recessed within the body chamber.

34 Claims, 11 Drawing Sheets

STRINGED MUSICAL INSTRUMENT WITH APPARATUS ENHANCING LOW FREQUENCY SOUNDS

This is a continuation-in-part application of provisional application Ser. No. 60/034,635, filed Jan. 3, 1997.

BACKGROUND OF THE INVENTION

This invention relates to acoustic stringed musical instruments and, more particularly, to devices and arrangements for enhancing the low frequency response of such instruments.

Recently, one stringed instrument, the acoustic guitar, has been provided with bodies that are relatively thinner than prior traditional instruments. Although the thins body instruments are easier and more comfortable to play, because of the thinner bodies, an unfortunate trade off results. A detrimental side effect based upon the acoustics and physics is created when making an acoustic string instrument with a thinner than traditional body. One problem is less air space in the instrument's body resonating cavity (this volume or space) used to effectively generate a micro air current when a string is struck, results in sympathetic vibration, i.e., available air mass and consequently effective volume and low frequency response is reduced. The result is less air mass available for the strings (especially for the low frequency strings, typical examples: E or D strings) to create vibrations which resonate in the body cavity. Another result is that in such thin body instruments, volume (loudness measured in Db or DBSPL—decibels measured by sound pressure level) and the subsequent resulting low frequency response characteristics are effectively reduced.

Over the years, manufacturers have attempted to compensate for the reduced low frequency response and volume (loudness) with electronic sound conditioning devices, such as: electronic equalizers, volume controls and boost circuitry built into the body, which are tied into an internal microphone, electronic pick up, or other electronic sound detection or amplifier devices.

The draw back of all of the above mentioned electronic sound conditioning compensation devices is that they are working in a low frequency and volume impaired body cavity environment, which does not produce vibrations in a range comparable to the rich full frequency sound spectrum of a full size or traditional model as a source. Thus, the prior art electronic pick up and amplifying devices as recognized by the present inventor amplify acoustic waves that are initially deficient in their overall response characteristics in the low frequency spectrum, i.e., at approximately and below about 500 Hz.

Sympathetic strings have been used in the prior art in an attempt to increase resonance. These strings are located in the instrument body resonating chamber and are intended to respond to incidental acoustic energy in the chamber. These strings are intended to vibrate sympathetically in response to incident acoustic energy, i.e., sympathetic vibrations are vibrations which resonate at the fundamental or harmonic frequencies of the incident acoustic energy. The problem with such strings, as recognized by the present inventor, is that the sympathetic string system lacks the mass or area to move sufficient amounts of air to effectively increase volume and low frequency response characteristics to be acoustically effective to a listener.

SUMMARY OF THE INVENTION

A string instrument according to an embodiment of the present invention comprises a body having a resonant chamber; at least one string manifesting a tone of a given frequency secured externally of and to the body and of the chamber for producing first acoustical waves in a range of frequencies, the chamber exhibiting second acoustic (e.g., sympathetic) waves in a range of frequencies responsive to and corresponding to the first waves; and acoustic wave enhancing means coupled to the body and to the chamber for enhancing the lower frequency portion of the range of frequencies of the second waves.

The acoustic wave enhancing means preferably comprises a passive radiator secured to the body, and responsive to the second waves for producing sympathetic acoustic waves that contribute to increased low frequency response and volume.

The body has front and rear faces, the strings are strung over the front face, the passive radiator may be either in the body rear face, the front face or both. The passive radiators in the corresponding front and rear faces may be identical or different dimensions and/or configurations and may be flush with or recessed in the rear face. The passive radiator configuration, shape, material, front or rear position and size will depend on the instrument being modified.

The acoustic wave enhancing means may also comprise isolated resonating tuned wave guide means secured to the body in the chamber and may comprise a planar sheet member secured to spaced posts, the posts being secured to the body and may be secured to the rear or front faces.

In a further aspect, the wave guide means may comprise a plurality of spaced planar sheet members each secured to a pair of spaced posts, the posts being secured to the body, the spacing size, width, height, thickness, flexibility and subsequent acoustic sensitivity of the sheet members are arranged for tuning the isolated tuned resonating wave guide means. The wave guides may be arranged in cooperating pair sets each set having a given tuned frequency response or as a single wave guide.

The front face may optionally have an opening, sometimes referred to as the sound hole, in communication with the chamber, the wave guide(s) direct waves in the low frequency portion of a range of frequencies in the chamber toward the opening.

The strings each generate an acoustic wave of a given frequency and its harmonics in a range, and in a further aspect, the opening in the front face may have a portion adjacent to the lower frequency strings that is sufficiently large to correspond to and enhance the passage therethrough of lower frequencies of the second waves to enhance the volume of the generated waves. The opening portion may be transversely larger in the direction of the strings that generate lower frequencies than the remainder of that opening. The opening may be generally triangular, T or L-shaped. The shape of the openings may emulate the curve(s) and slope(s) of a graphic or parametric equalizer in a non-electronic (acoustic) form. The result is an emphasis on the reproduction of desired frequencies. This is accomplished by allowing more low frequency waves into the resonating body and reflecting the string generated higher frequency waves from the front face The acoustic wave enhancing means in a further aspect comprises means for enhancing the harmonics of the frequencies of the lower frequency strings. The acoustic wave enhancing means in a further aspect comprises means for enhancing fundamental tones of the lower frequency strings.

The acoustic wave enhancing means preferably comprises means for increasing the number of generated lower frequencies, and the volume measured in Db and DBSPL of the tones produced by the lower frequency portion of the strings.

The acoustic wave enhancing means may comprise acoustic responsive means exhibiting a response that is a manifestation of an increased volume (loudness) comprising enhanced low frequency sympathetic vibration. Such increased volume and/or enhanced vibration produce an acoustic response that sounds more natural to the human ear for a given instrument. This increased volume and enhanced vibration is a simulation of a full size (e.g., deeper body cavity) instrument. When electronically picked up (detected with a microphone) and reproduced via amplification, the enhanced resulting sounds appear similar to an original full body instrument. Such enhancement may also be provided a full body instrument to further enhance its low frequency response.

The size and location of the passive radiator depends on the application and degree of effect (frequency response and volume) desired. The passive radiator functions with or without a sound hole in the front face. The passive radiator may be used in conjunction with isolated tuned resonating wave guides which serve to enhance and direct sound waves and increase sympathetic vibration in consort with the passive radiator. Hence, both the passive radiator and the wave guides when used in conjunction directly increase low frequency reproduction, volume and directionality in the body cavity of a string instrument. These devices similarly effect (at present, to a lesser degree) solid body string instruments.

In a further embodiment, the body has a directive curved side wall(s) connecting the front and rear faces. The acoustic wave enhancing means includes a planar side wall portion of the side wall for providing directionality to the sound waves in the body chamber.

All of the enhancement means may be combined to provide a cumulative enhancement effect.

BRIEF DESCRIPTION OF THE DRAWING

In FIG. 1*a*, stringed instrument 2, a guitar for example, has a body 3 with a front face 4 and a neck 6. Not shown are the strings, bridge and accompanying connections for attaching the strings to the front face and neck, which are conventional. The strings normally overlie the front face and neck with the low frequency string(s) (not shown) being closest to the left side 8 of the body 3 in the figure.

Figure 1A:
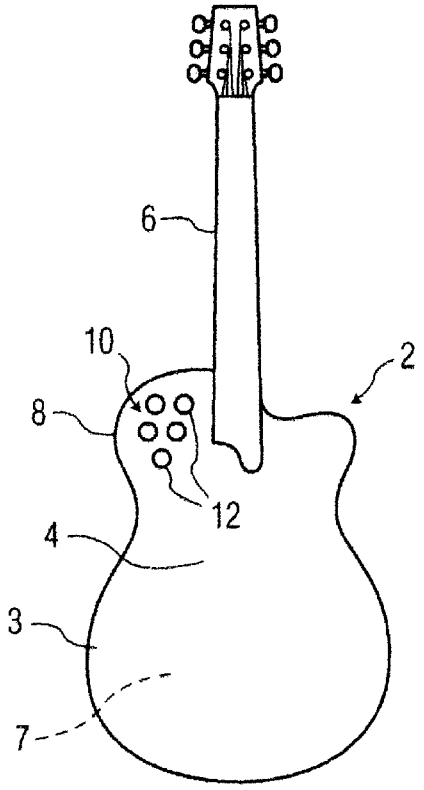
FIG. 1a PRIOR ART
FIGS. 1*a*–1*e* illustrate various shaped sound holes in the front face of prior art guitars and the shape of such guitar bodies including a guitar without a sound hole.

An array 10 of relatively small sound openings 12 are disposed in a corner of the front face 4 between the neck 6 and side 8. The openings permit acoustic waves to pass directly therethrough to the ambient from the body 3 chamber 7 formed by the faces and sides.

Figure 1B:
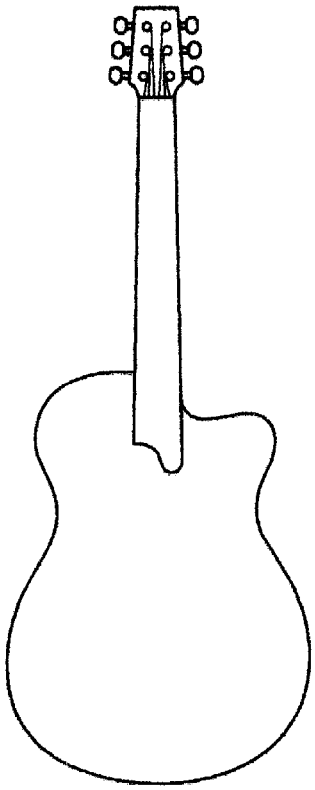
FIG. 1b PRIOR ART
Figure 1C:
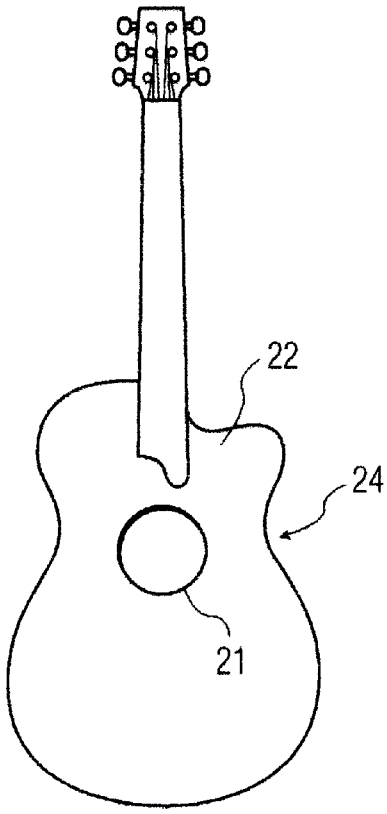
FIG. 1c PRIOR ART
Figure 1D:
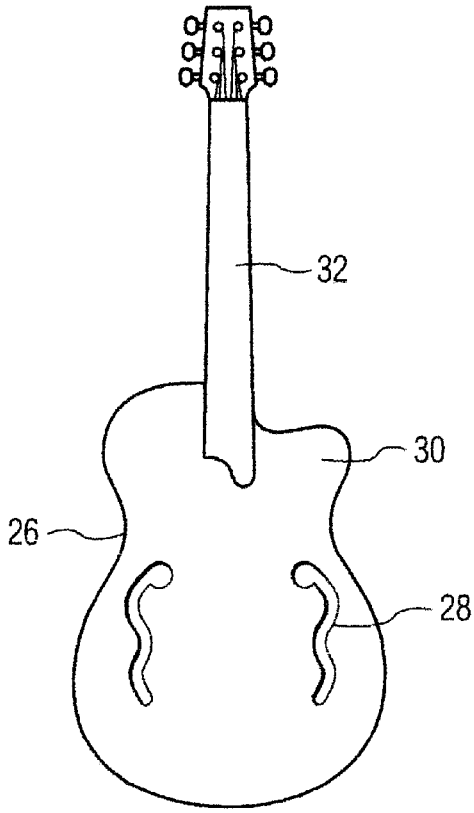
FIG. 1d PRIOR ART
Figure 1E:
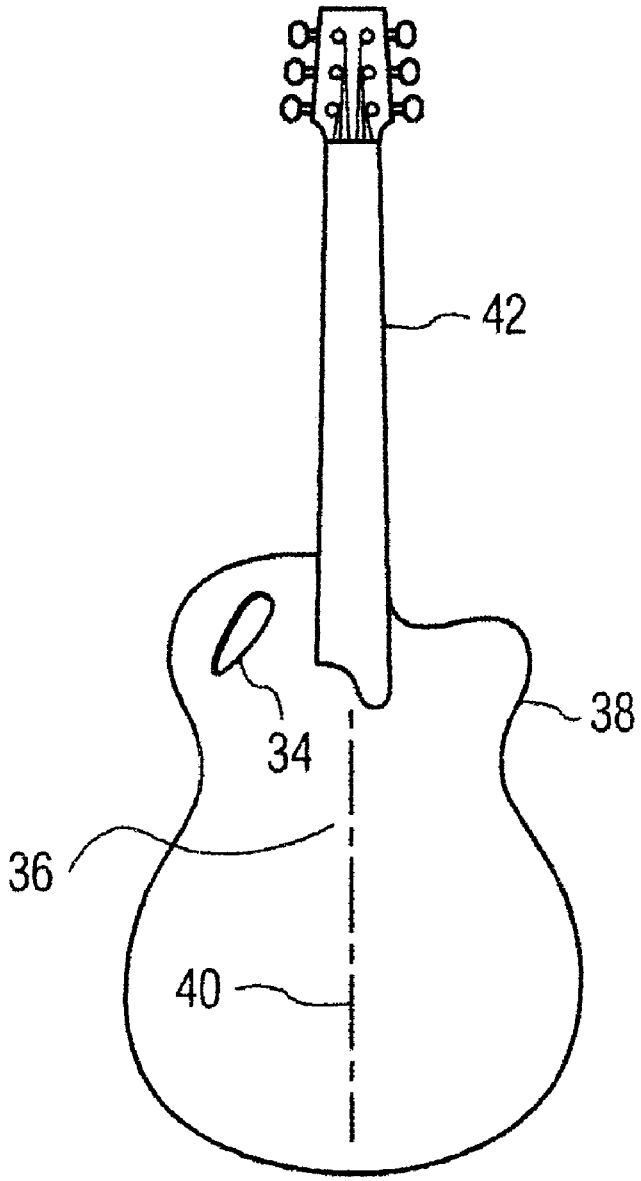
FIG. 1e PRIOR ART

In FIG. 1*e* instrument 14 according to an embodiment of the present invention front face 15 has an array 18 of different length slotted sound transmitting openings 20 in communication with the body chamber. The openings 20 increase in length as the array approaches the side wall 16 distal the low frequency string(s), a smaller slot being closer to the low frequency string(s) (not shown). The openings 20 generally are between the low frequency string(s) and the side 16 and a portion of the openings are juxtaposed with a portion of the low frequency strings (not shown). The largest longest slot is between the low frequency string and the side 16.

In FIG. 1*c* a conventional circular sound opening 21 is in the front face 22 of instrument 24. All of the openings in FIGS. 1*a*–1*c* are adjacent to the neck end of the body which has an hour glass shape.

FIG. 1*d* illustrates a body 26 with conventional violin type undulating openings 28 arranged in a mirror image spaced pair in the body front face 30. The openings 20 are in the face of the body distal the neck 32 in the wider portion of the body 26.

FIG. 1*e* illustrates a single relatively small elliptical opening 34 in front face 36 of body 38. The opening 34 longitudinal axis is inclined generally with respect to the axis 40 along which the strings (not shown) and neck 42 extend. The opening is in a corner of the body adjacent to the neck 42. FIG. 1*f* illustrates a body with no sound hole and the general shape of a conventional guitar string instrument wherein the side walls are continuously curved with no plane portions.

None of the embodiments of FIGS. 1*a*–1*e* illustrate sound holes that enhance low frequency response (no more than about 500 Hz). These sound openings may increase sound volume, but are not designed to increase the volume of low frequencies in particular. Generally, these openings are more effective with the transmission of middle and higher frequencies than low frequency acoustic waves.

Figure 2A:
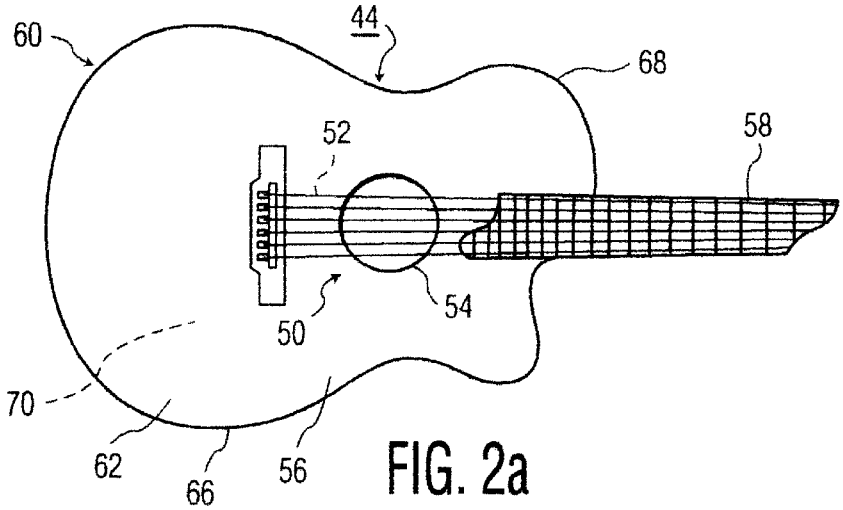
FIGS. 2*a*–2*c* illustrate different stringed instruments with FIGS. 2*a* and 2*b* showing sound holes and FIG. 2*c* showing no sound hole.
Figure 2B:
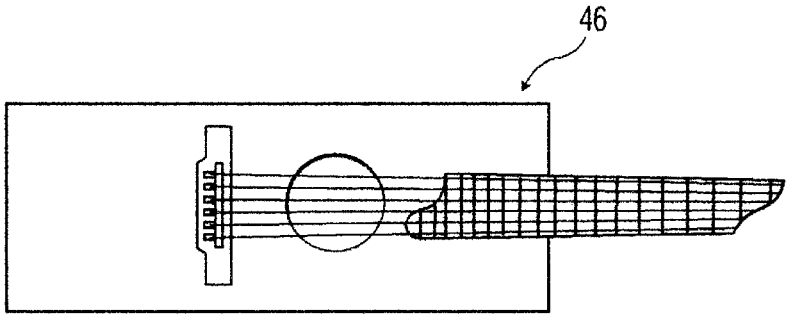
Figure 2C:
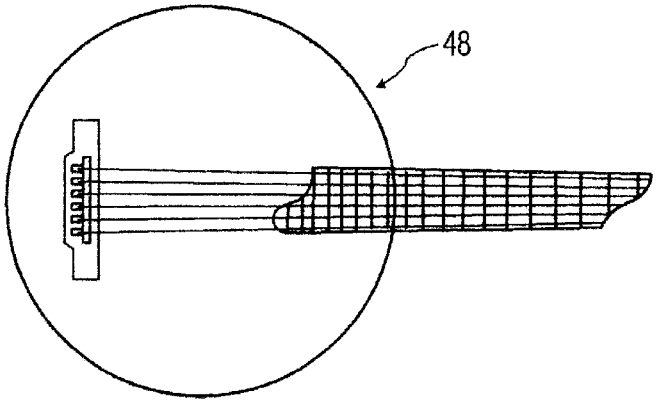

FIGS. 2*a*, 2*b* and 2*c* illustrate the front face and neck portions of conventional stringed instruments, including a guitar 44, FIG. 2*a*, a regular rectangular polygon body instrument 46, FIG. 2*b* and a banjo 48, FIG. 2*c*, which has no sound hole. These are given by way of example, as stringed instruments include a much greater array of configurations including cellos, violas, fiddles, violins and so on. All of these instruments may be provided enhanced low frequency response according to the arrangements of the present invention.

In particular, the guitar 44, FIG. 2*a*, will be described in representative fashion. The guitar 44 has a wooden or composite relatively thinner body depth than a traditional guitar. A traditional body might be about 4.5–10 inches thick whereas a reduced depth body may be about 2–4 inches thick. The body 60 is fabricated from thin wooden sheets in the conventional manner and composite materials in a more advanced state of construction. Such a guitar has a body chamber 70 that normally tends to exhibit poor low frequency response due to the reduced body depth, i.e., the height of the sides 66 between the front and rear faces. None of the opening arrangements illustrated in FIGS. 1*a*–1*e* provide effective enhancement of such low frequency response. The term "enhance" as employed herein in connection with frequency response of a stringed musical instrument is intended to mean increased decibel dB response characteristics as measured in DBSPL, i.e., increased volume (loudness). Such enhancement may be provided by inducing vibrations, increasing the intensity of vibrations or by providing or increasing low frequency resonance and directivity.

Figure 3:
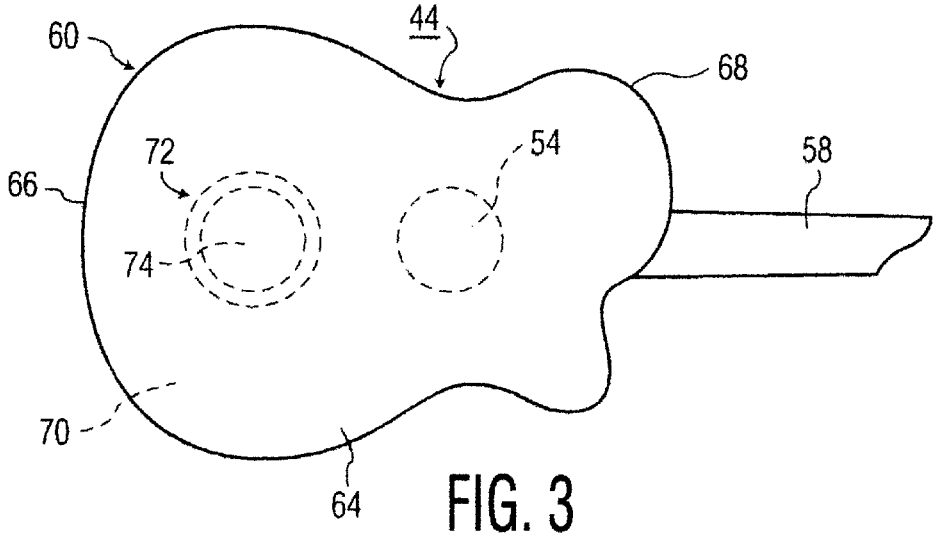
FIG. 3 illustrates the rear face of the instrument of FIG. 2*a* with a passive radiator according to an embodiment of the present invention.

The guitar 44 has strings 50 with a low frequency E string 52 and a central circular opening 54 in the front face 56 adjacent to the neck 58. The body 60 has a front face 62, FIG. 2*a*, and a rear face 64, FIG. 3. The body 60 has continuous hour glass shaped curved side 66 with a narrower end portion 68 forming chamber 70. The body 60 is thinner in depth than a traditional guitar body.

Figure 9:
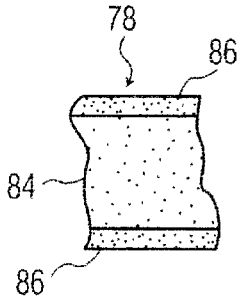
FIG. 9 is a sectional fragmented elevation view of a portion of FIG. 10 taken at region 9 showing the construction of a representative passive radiator.
Figure 10:
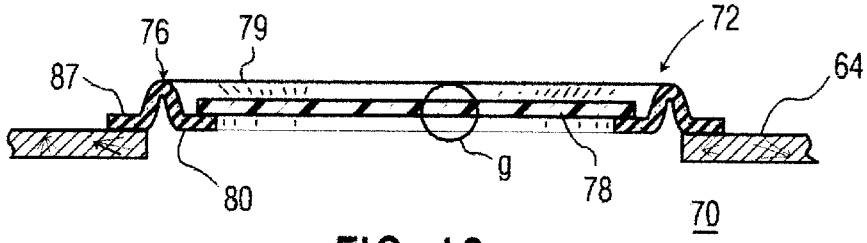
FIG. 10 is a side elevation fragmented sectional view of the passive radiator portion of FIG. 7.

A passive radiator 72 is attached to the body 60 rear face 64 in a preferably circular opening 74. Passive radiator 72, FIGS. 9 and 10, comprises a surround 76 and a central plate 78 secured to the surround 76. The surround 76 may be molded thermoplastic or elastomeric, e.g., fabric, rubber or rubber compound materials. This latter material preferably may be foamed and cellular. The surround 76 has a generally U-shaped cross section with a central U portion section 79 terminating in a radially inward extending inner annular flange 80 and a radially outwardly extending outer flange 82. The outer flange 82 is secured, e.g., bonded, or otherwise fastened, to the rear face 64. The section 79 in this embodiment protrudes externally of the chamber 70 on the outer side of rear face 64. Plate 78 is secured to the inner flange 80 on a side facing the chamber 70. In FIG. 9, plate 78 comprises a foam core 84 sandwiched between paper layers 86 forming a laminated structure. The plate element of the passive radiator is not limited to foam core sandwiched between paper layers.

The plate 78 may have any desired thickness and diameter as determined empirically for given desired instrument response characteristics. The diameter of the passive radiator, its material and thickness of the plate 78 all cooperate to provide a given sympathetic response to incident low frequency acoustical waves. Sympathetic response means that the resonator 72 will vibrate at the same frequency of the incident waves or at harmonics of those waves.

The dimensions including the shape of the radiator 72, which may be other than circular, thus are determined to cooperate with a given instrument body having certain inherent frequency response characteristics. By way of example, in one test, the core plate 78 was 3 7/16 inch diameter and a second core plate 78 was 4 1/8 inch diameter, both 3/16 inches thick. Instruments with these radiators exhibited good low frequency response improvements.

What is desired is that the passive radiator 72 respond generally to frequencies at and below 500 Hz to provide improved DBSPL and low frequency response. Such resonance provides an increase in volume as measured in DBSPL response to the resonating waves in the chamber 70. The proximity of the radiator to other elements in the instrument and the diameter, shape, weight, rigidity and acoustic wave reflectivity of the plate 78 and the flexibility of the passive radiator surround as well as other variables also control the volume response in the low frequency spectrum.

Figure 12:
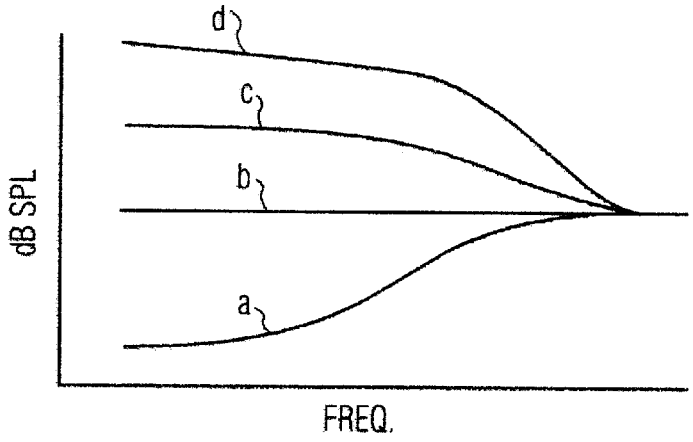
FIG. 12 is a graph useful for explaining certain principles of the present invention.

In FIG. 12, for example, a stringed instrument with a reduced depth was fitted with a passive radiator in accordance with the present invention. Curve a shows the frequency response characteristics of a traditional instrument. The DBSPL (decibel sound pressure level) is considerably reduced in the low frequency range below about 500 Hz. Curve c illustrates the response characteristics with a passive radiator on the instrument as described above. The dBSPL in the low frequency spectrum shows increased values manifesting an enhanced low frequency response.

Figure 15:
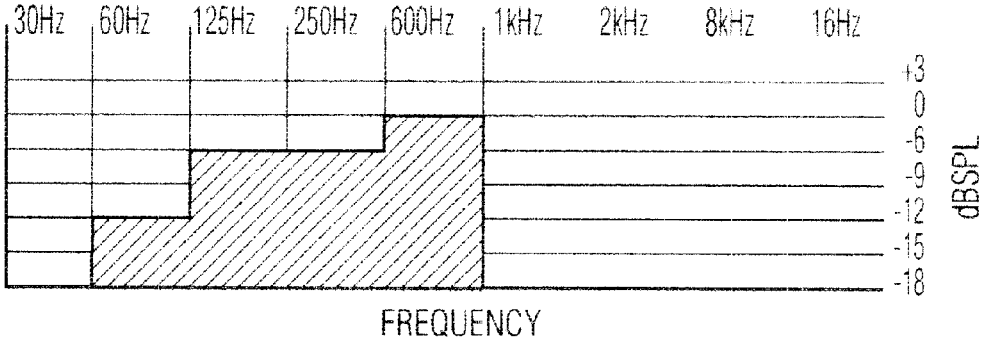

In FIG. 15, a traditional stringed guitar instrument without a sound hole was tested for response in the low frequency spectrum. The DBSPL response at 500 Hz is at 0, at 125 to 250 Hz, the response is at −6 Db, at 60 Hz the response is at −15 Db and at 30 Hz no measurable response is evident.

Figure 14:
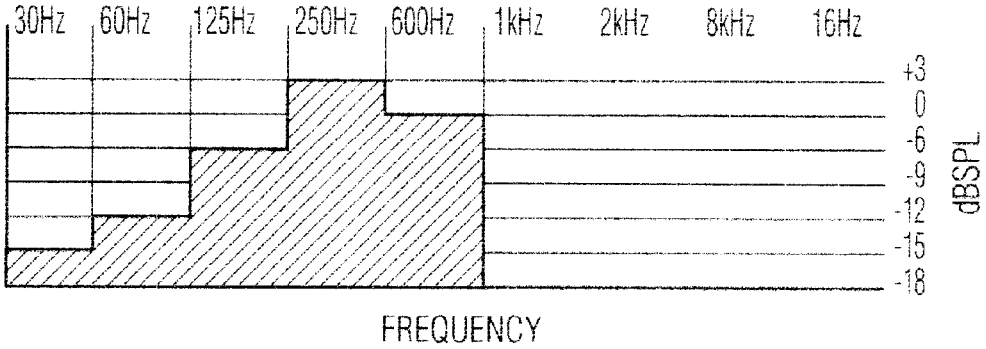
FIGS. 14 and 15 are respective graphs showing response characteristics of an instrument employing an embodiment of the present invention with a passive radiator with no sound hole and a prior art instrument with no sound hole and no modifications.

In FIG. 14, the same instrument was fitted with a passive circular radiator as described hereinabove. The 250 Hz response is improved to +3 Db, a 9 dB improvement. The 60 Hz response is improved to −12 Db, a 3 Db improvement and the 30 Hz response is now at −15 Db whereby it previously was not measurable. The tests were measured with an open microphone employing a spectrum analyzer.

Observation of the responses on an oscilloscope with various stringed instruments of different designs showed increased responses including harmonics with a passive radiator.

These response improvements, of course, are a function of the characteristics of a given instrument design and passive radiator design configuration including material, dimensions and position in the instrument. Improved responses can be determined empirically for providing further enhancement by varying each of the involved variables to obtain an optimum response for a given instrument.

An opening may be formed in the instrument with a cover plate of a given diametrical dimension corresponding to a given passive radiator diameter. Different diameter or shaped radiators may be installed in the instrument until optimum response values are observed. Then such a passive radiator would be installed in all such identical instruments.

Figure 4:
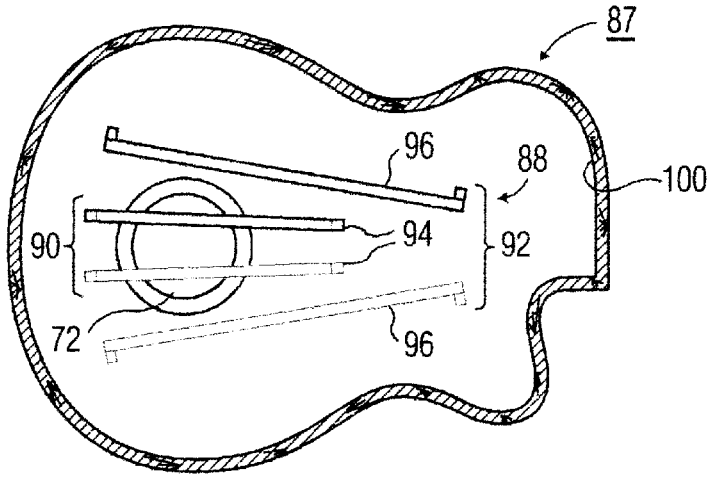
FIG. 4 is a sectional top plan view of the instrument of FIG. 2*a* with the front face removed (for purposes of illustration) according to a second embodiment of the present invention.
Figure 7:
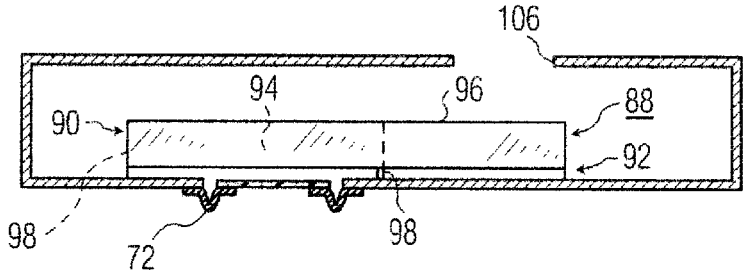
FIG. 7 is a side sectional elevation view of the instrument of FIG. 4.
Figure 8:
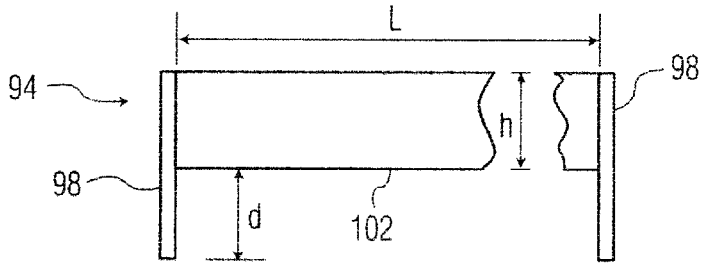
FIG. 8 is a fragmented side elevation view of a representative wave guide used in the embodiment of FIG. 4.

In FIGS. 4 and 7, a further embodiment illustrates a stringed instrument 87 employing a wave guide array 88 in combination with passive radiator 72. Array 88 comprises two respective pairs 90 and 92 of wave guides 94 and 96. In FIG. 8, representative wave guide 94 will be described and which is constructed the same as the other wave guides 96 except wave guides 96 are longer. Still other wave guides, not shown, may be employed of different lengths and also of different dimensions and materials in accordance with a given implementation.

Wave guide 94 comprises two spaced posts 98 which may be of any suitable material, e.g., wood, metal or plastic, are fastened in the chamber 100 of instrument 87, FIG. 4. In the alternative, a single wave guide may be provided. Secured to and between the posts is a wave guide plate member 102.

Figure 11:
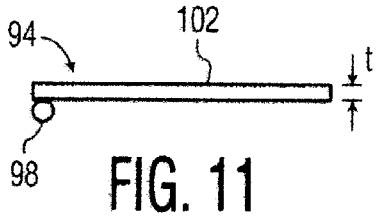
FIG. 11 is a fragmented top plan view of a portion of a representative wave guide member.

Member 102 has a thickness t, FIG. 11, that is relatively small, preferably of a thickness, e.g., a fraction of an inch, and of a material to further enhance the desired acoustic effect. The member 102 has a height h, FIG. 8, which may be about 1–2 inches, for example, and preferably one inch. The length L is determined in accordance with a given implementation. The member 102 is spaced above the body face, either rear or front or both, a distance d to provide the desired acoustic conductive vibration isolation The values of d, h, L and t are determined empirically for a given implementation according to a particular instrument and the characteristics of that instrument. Determining such values is within the skill of one of ordinary skill in the acoustic device design art.

In FIG. 4, the wave guides 94 are pinned securely to the body, and can be attached toward the top of the pin to provide the acoustic isolation from the body, and in some cases, pass over the passive radiator 72 and may be secured to the front or rear face. The wave guides 94 are spaced apart a distance to provide directivity to low frequency waves in chamber 100. They guide the acoustic waves to the sound opening traditionally in the front face. The wave guides 94 are preferably inclined toward one another so that the ends adjacent the opening 106, FIG. 7, in the front face are closest together. This directs the low frequency waves toward the opening 106. The wave guide pair 90 are set to provide directivity to waves of a certain (appropriate) frequency(s).

The wave guides also provide enhanced low frequency response, i.e., increasing the number of frequencies generated by sympathetic response, in a manner similar to a passive radiator and also provide enhanced volume.

Wave guides 94 of pair 90 are nested within the wave guide pair 92, which are for this illustration longer. The wave guides 96 of outer pair 92 are inclined (tapered) toward each other as the wave guides approach the opening 106. In this case the pair 92 extends juxtaposed beneath the opening 106. The pair 92 may be identical to pair 94 except in this illustration are longer. The ends of the wave guides adjacent to the opening 106 are closest together to direct waves to the opening 106. The spacing between the wave guides is determined by the wave frequencies to be acted upon by the wave guides.

The pair 90 is constructed, dimensioned and spaced to direct waves in the low frequency range to the opening 106. This provides enhanced volume of the waves through the opening 106. It is preferred that the ends of the wave guides adjacent to the opening 106 be closer together than the opposing ends to provide the desired directivity of the acoustic waves to the opening 106. The number of wave guide pairs, their location, spacing, construction and dimensions is determined for a given implementation. All of the variables involved may effect low frequency response and volume and may be provided in different combinations to achieve an optimum response, i.e., frequency and/or volume.

Figure 5:
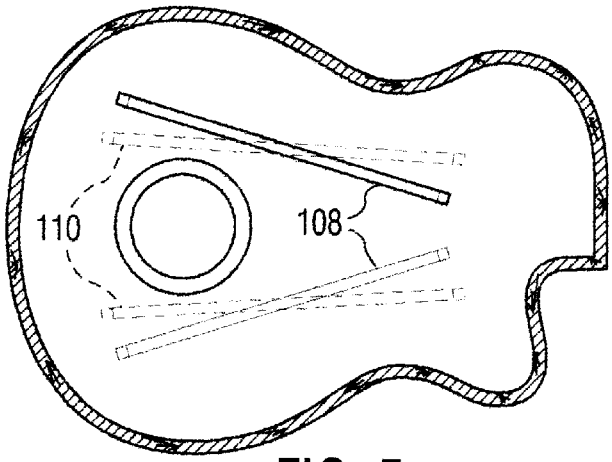
FIG. 5 is a sectional top plan view of the instrument of FIG. 2*a* with the front face removed (for the purpose of illustration) according to a further embodiment of the present invention.
Figure 6:
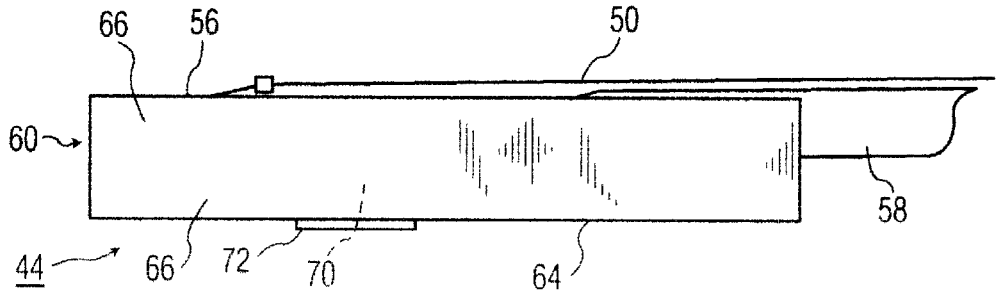
FIG. 6 is a side elevation view of the instrument of FIG. 3.

For example, in FIG. 5, another embodiment is illustrated employing two wave guides 108. These guides are inclined at a steeper relative inclination than the guides of FIG. 4. Also, only one pair is utilized. These wave guides can be curved in a variety of configurations (not shown) to further direct and enhance their resonating properties. The opening (also not shown) in the front face is juxtaposed with the guides 108 at their closest region at the right of the drawing figure. A second pair of guides 110 (shown in phantom) are shown in more nearly parallel arrangement. The solid line guides 108 are believed to provide greater directivity to the low frequency waves toward the sound opening.

In the alternative, the wave guides need not be in pairs, but may comprise an odd number of guides such as one or more, the latter also may be in staggered, i.e., offset, arrangements.

In FIG. 12, curve b illustrates the relative response improvement provided by wave guides. The passive radiator response, curve c, provide enhanced DBSPL response as compared to the wave guide curve b. Curve d, however, shows that the combined radiator and wave guide construction is best for a given instrument. The introduction of an equalized (modified) sound hole (a hole whose shape emulates the preferred response curve and slope) also enhances low frequencies and the chamber's resulting resonant reproduction of the frequency(s) volume (not shown in the graph of FIG. 12). The devices in combination have a cumulative effect.

The passive radiator may be attached to either the rear or front face. Also, a radiator may be attached to both faces. Further, the wave guides may be used with or without a radiator. It is preferred that the wave guides be attached to the rear face. A particular instrument cabinet will be arranged with a given radiator and/or wave guides according to the cabinet body characteristics. The corresponding factors are determined empirically for each body design.

By increasing the number of or amplitude of vibrations in a resonant cavity, an increase in frequency range and/or volume may be provided. The passive radiator improves sympathetic vibrations and the wave guides provide directivity and volume increase to low frequencies. The cumulative resonance of the entire structure including the walls, the strings, shape, size of the cabinet body producing a given air mass and wall mass contribute to the overall response. These all contribute to coupling of various vibrating bodies vibrating at different frequencies complementing the acoustic resonant frequency of the body.

Where no sound hole is provided in the front face the front face provides reflection of the waves from the strings.

However, the body also vibrates creating resonance in the body chamber. The latter create the sympathetic response of the radiator. The sympathetic response may be at a given frequency or at harmonics of that frequency. The body chamber and the passive radiator may resonate at different frequencies. Sympathetic vibration frequencies may differ from the resonant frequency of a stringed instrument with a sound hole, which resonant frequency is at the same frequency as the first strike fundamental frequency or harmonics thereof. The resonance and subsequently the ability to reproduce the desirable lower frequencies in the body chamber are further enhanced singularly or in combination with the aforementioned devices, when the face response sensitivity to sympathetic vibration is greater. This is accomplished with more flexible and pliant body materials.

Figure 13:
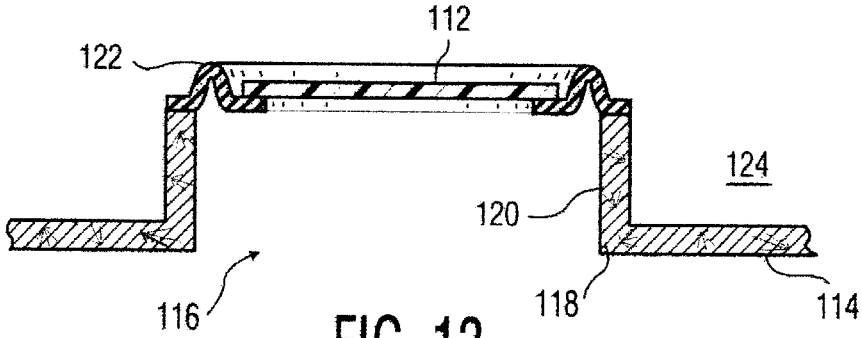
FIG. 13 is a fragmented sectional elevation view similar to that of FIG. 10 of a further embodiment of a passive radiator.

FIG. 13 illustrates a further embodiment. Typically, for guitars, the user places the rear face against the user's body. This might interfere with and dampen the operation of the passive radiator 72, see FIG.7, which radiator is flush with the body rear face. This problem is overcome by the embodiment of FIG. 13 wherein the passive radiator 112 is recessed. The body rear face 114 of instrument 116 has a circular opening 118. A mounting sleeve 120 or an equivalent tapering contour of the rear face (not shown) forming an inwardly depending projection is secured to (or manufactured as part of) the rear face 114 in opening 118. The sleeve 120 at the rear face 114 is formed of preferably wooden sheet material, but may be other materials. The passive resonator 112 is secured via its surround 122 to the end of the mounting sleeve 120 in the body chamber 124.

Figure 16A:
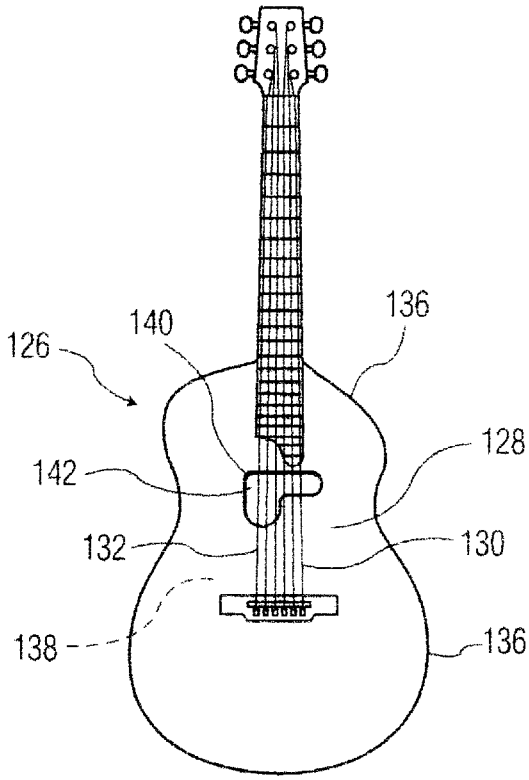
FIGS. 16*a*–16*e* are top plan views of stringed instruments with sound holes according to different embodiments of the present invention and with a body shape according to an embodiment of the present invention.

In FIG. 16*a*, guitar instrument 126 has a front face 128 and strings 130. For example, the a low frequency string 132 is to the left in the drawing. The body side wall 134 is formed by a continuous curve in an hour glass shape as in prior art instruments except for side wall 134 portion 136. Wall 136 is essentially planar. This wall 136 provides a different contour to the body and enhanced directivity to waves in the instrument chamber 138. The waves are directed toward opening 140. This tends to enhance volume response of the low frequencies.

Further, the opening 140 is unique in that it has a larger portion 142 aligned juxtaposed with the low frequency string 132. The remaining portion 144 may be of narrower configuration in a direction parallel to the direction of the strings 130. This-forms the opening 140 into a generally L-shape configuration.

Figure 16B:
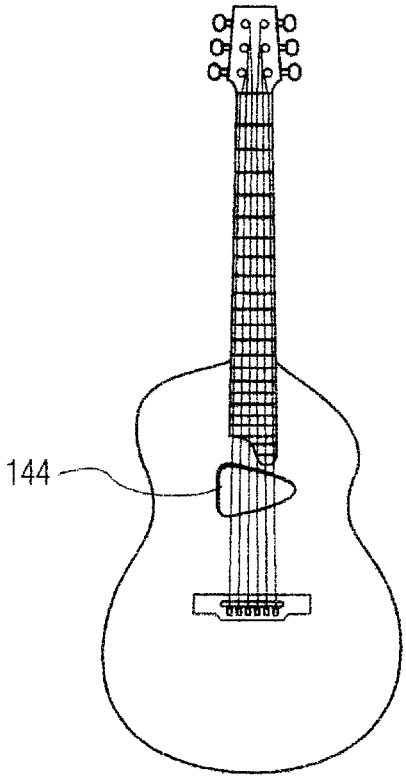
Figure 16C:
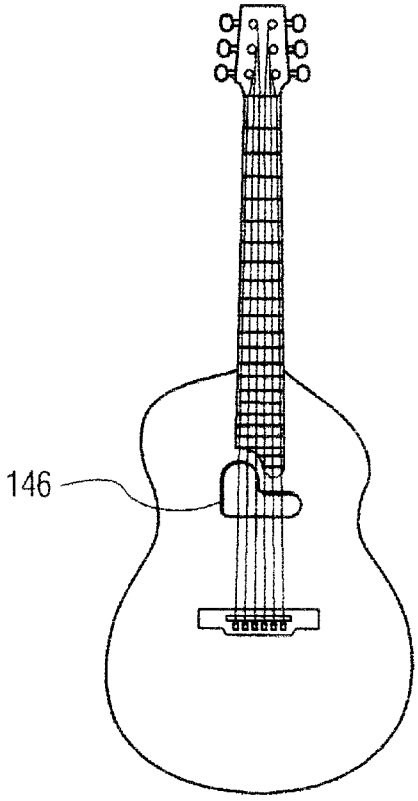
Figure 16D:
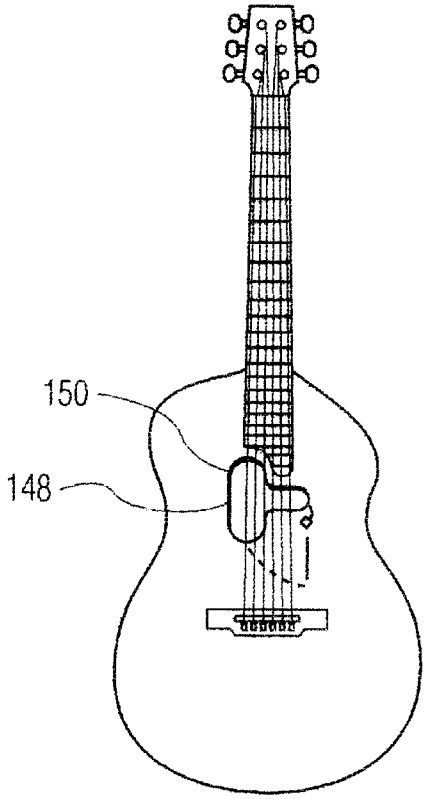
Figure 16E:
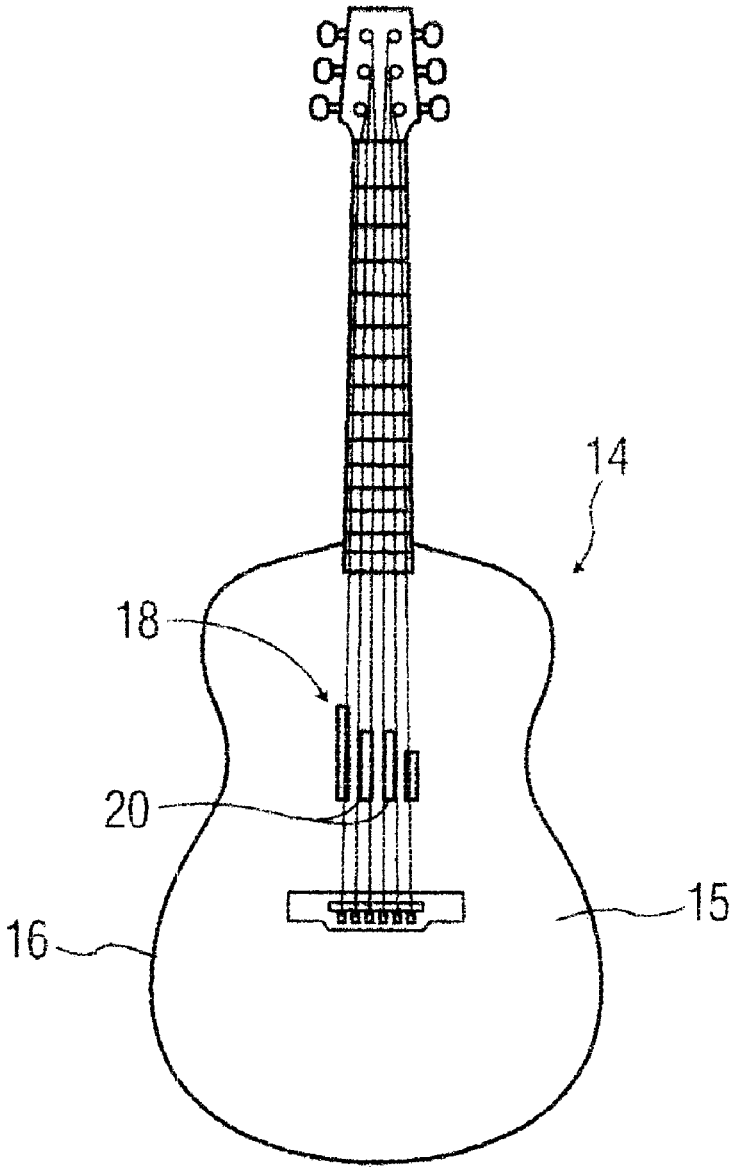

Other openings are shown in FIGS. 16*b*, 16*c* and 16*d*. In FIG. 16*b*, the opening 144 is generally triangular in shape with the largest portion adjacent (open) to the lowest frequency string 132 (not shown in this figure). In FIG. 16*c* the opening 146 is inverted in respect to the orientation of the opening 142, FIG. 16*a*. The larger portion of opening 146 still is juxtaposed with the lowest frequency string. In FIG. 16*d* the opening 148 is somewhat T-shaped with the top of the T cross portion 150 juxtaposed with the lowest frequency string (not shown in this figure). The larger opening portions juxtaposed with the lowest frequency string provides improved dB and frequency response of the lower frequencies. This is essentially an equalized sound.hole whereby the shape of the curve of the sound hole contributes to determination of the initial resonant frequencies of the cabinet. In the prior art, either no opening is so positioned relative to the lowest frequency string or a smaller portion of the opening is so juxtaposed denying the body cavity exposure to a greater amount of low frequency waves generated by the first strike fundamental frequency of the lowest frequency string.

While a passive radiator has been described that is fixed in place, a releaseably attached radiator selected from a group of radiators of different sizes may be provided. The radiator may be attached to a corresponding plate (not shown) having a corresponding opening size. The radiator is attached over the mating plate opening. The plate and attached radiator are then releaseably clamped or fastened to a face of the instrument over a further opening in the face. The face opening for the radiator is larger than the radiator diameter or peripheral configuration. The radiator plate and the attached radiator covers that face opening. In this way a radiator of appropriate dimensions and characteristics may be matched empirically to the instrument to obtain the desired optimum low frequency response.

In addition, the plate securing the radiator and instrument face may include fastening devices so the plate and radiator may be displaceable to an optimum position on the mating instrument face. The plate is then clamped in the desired place using fastening devices such as clamps or screws and mating threads attached to the face and plate.

There thus has been described a flush or recessed passive radiator mounted in the rear and/or front face of a acoustic body chamber with optional tuned resonating wave guide(s) mounted proximate to the passive radiator(s). The passive radiator is shown in a flush and in a recessed rear mount configuration. The flush mount configuration of the passive radiator is not recommended for an instrument that is to be held against a person playing the instrument so as to interfere with the function of the passive radiator.

Thus, a rear and/or front mounted recessed and/or flush passive radiator with or without tuned wave guide(s) have been described. Variable sizes and shapes are selected to optimize the effects of the devices. Tuned isolated resonating wave guide(s) without a passive radiator have also been described for use in the instrument body chamber.

The wave guide or guides are provided optimal positions for optimum acoustic effect, i.e., to provide maximum sympathetic (or resonating) vibration, maximum low frequency increase, and specific (or tuned) sympathetic frequencies and volume, created by the interaction of the passive radiator(s), tuned wave guide(s) selectively coupled to the front and/or rear faces, and optimization of the side(s) of the body cavity.

These arrangements are further enhanced by (and can be used independently or in conjunction with) the equalized sound holes 140, 144, 146 and 148 (FIGS. 16*a*–16*d*). Further enhancement is provided when used in conjunction with a closable sound hole door 151, FIG. 16*d*. This door allows the user to control the amount of low frequencies available to the body cavity and the cavity's subsequent resonance characteristics.

The sound hole door 151 is hinged for displacement in directions 155 to the corresponding face plate at pin 153 adjacent to the sound opening 148 to selectively fully or partially open or fully close the opening in incremental amounts in a range of different opening sizes and shapes created by the door whose edge may be contoured for further acoustic equalized sound effect.

While the enhancement devices are illustrated for use with a reduced body thickness instrument, such devices may be used with traditional instrument bodies as well to further enhance the low frequency response of such instruments. In addition, the bodies of the instruments may also be changed in shape other than as described herein to enhance the low frequency response. For example, the hour glass shape of a guitar may have its larger portion distal the neck made wider.

It will occur that various modifications may be made to the disclosed embodiments which are given by way of example and not limitation. It is intended that the invention be defined by the appended claims.

What is claimed is:

1. A string instrument comprising:

a first body having a resonant chamber;

a plurality of strings each manifesting a tone of a different frequency secured to and external to the body and over the chamber for producing first acoustical waves in a range of frequencies, the chamber exhibiting second acoustic waves in a range of frequencies responsive to and corresponding to the first waves; and acoustic wave enhancing means coupled to the body and to the chamber for selectively enhancing only the acoustic waves of the lower portion of the range of frequencies of the second waves.

2. The instrument of claim 1 wherein the acoustic wave enhancing means comprises a passive radiator responsive to the second acoustic waves and secured to said body for producing sympathetic acoustic waves.

3. The instrument of claim 2 wherein the body has front and rear faces, the strings overlying the front face, and further including means for securing the passive radiator to the body rear face.

4. The instrument of claim 2 wherein the body has front and rear faces, the strings overlying the front face, further including means for securing the passive radiator to the body front face.

5. The instrument of claim 2 wherein the body has front and rear faces, the strings overlying the front face, further including means for securing a passive radiator to each of the body front and rear faces.

6. The instrument of claim 5 wherein the passive radiators on the different faces are different.

7. The instrument of claim 5 wherein the passive radiators on each face are the same dimensions.

8. The instrument of claim 1 wherein the acoustic wave. enhancing means comprises isolated tuned resonating wave guide means secured to said body in said chamber.

9. The instrument of claim 8 wherein the wave guide means comprises a planar member secured to spaced posts, the planar member being spaced from the body, said posts being secured to said body.

10. The instrument of claim 9 wherein the body has front and rear faces, said posts being secured to at least one of the front and rear faces.

11. The instrument of claim 8 wherein the isolated tuned resonating wave guide means comprises at least one planar sheet member secured spaced from the body by a pair of spaced posts secured to said body, the spacing and dimensions of said at least one planar sheet member for tuning the wave guide means.

12. The instrument of claim 11 wherein the wave guide means includes a plurality of wave guides each comprising said at least one sheet member and pair of posts and arranged in at least one cooperating pair set, said at least one set having a given resonant and directive frequency response.

13. The instrument of claim 8 wherein the body has front and rear faces, the front face having an opening in communication with the chamber, the wave guide means for guiding waves in the low frequency portion of the range of frequencies toward said opening.

14. The instrument of claim 1 wherein the strings each generate an acoustic wave of a given frequency and resulting harmonics in said range, said body having a front face and a rear face, the strings overlying said front face, said front face having an opening therethrough juxtaposed with the strings in communication with said chamber, said opening having a portion adjacent to the lower frequency strings that is sufficiently large to correspond to and enhance the passage therethrough of lower frequencies of said second waves and enhance the volume of said lower frequencies to effectively create an equalized sound hole.

15. The instrument of claim 14 wherein the strings extend in a given direction, said opening portion being transversely larger in the given direction than the remainder of said opening to create an equalized opening to the chamber that tends to resultin resonate lower frequencies in the chamber and reflection of higher frequencies from the front face.

16. The instrument of claim 15 wherein the opening is generally triangular.

17. The instrument of claim 15 wherein the opening is generally one of L-shaped, T-shaped and triangular, the opening having a length and a width, said length being perpendicular to the longitudinal direction of the strings.

18. The instrument of claim 15 wherein the opening is generally one of triangular, L-shaped and T-shaped, further including means for selectively settably closing the opening between full open and closed states to set the body chamber sympathetic response.

19. The instrument of claim 1 wherein the acoustic wave enhancing means comprises means for enhancing the harmonics of the fundamental frequencies of the waves produced by the lower frequency strings.

20. The instrument of claim 1 wherein the acoustic wave enhancing means comprises means for enhancing the fundamental frequencies of the waves produced by the lower frequency strings.

21. The instrument of claim 1 wherein the acoustic wave enhancing means comprises means for increasing the loudness of the fundamental frequencies and their corresponding harmonics of the waves produced by the lower frequency portion of said strings.

22. The instrument of claim 1 wherein the acoustic wave enhancing means comprises means for increasing the dBSPL of the fundamental frequencies and their harmonics of the waves produced by the lower frequency portion of said strings.

23. The instrument of claim 1 wherein the lower frequency portion of the waves is in a range of at and below about 500 Hz.

24. The instrument of claim 2 wherein the body has opposing front and rear faces with an opening in at least one face thereof, the passive radiator comprising a surround secured to the body about the opening and a planar sheet member secured to the surround over the opening.

25. The instrument of claim 24 wherein the passive radiator is secured to one of said faces, said planar sheet member being adjacent to said at least one face.

26. The instrument of claim 24 wherein the passive radiator is secured to one of said faces, said planar sheet member and surround being recessed within said chamber.

27. The instrument of claim 1 wherein a traditional instrument has a second body of a given depth greater than said first body and having low frequency response characteristics enhanced relative to the low frequency response of said first body due to its greater depth, said acoustic wave enhancing means including means arranged to cause said first body and strings to acoustically emulate the frequency response of said traditional instrument.

28. The instrument of claim 1 wherein said chamber exhibits a given lowest resonant frequency response, said acoustic wave enhancing means including means for causing said chamber to resonate at least one frequency lower than said lowest resonant frequency response.

29. The instrument of claim 2 wherein the passive radiator has a given sympathetic frequency response and causes a subsequent resonant frequency response within the chamber.

30. The instrument of claim 8 wherein the wave guide means comprises a plurality of isolated tuned resonating wave guide planar sheet members.

31. The instrument of claim 1 wherein the body has front and rear faces, the front face being juxtaposed with said strings, the front face having an opening therethrough, said opening being shaped and positioned for enhancing the low frequency response of said instrument.

32. The instrument of claim 31 including at least one of a passive radiator and wave guide coupled to said body, said one radiator and wave guide being coupled to at least one of said front and rear faces.

33. The instrument of claim 1 wherein the instrument has front and rear faces and a curved side wall connecting the faces and forming said chamber, said acoustic wave enhancing means including a planar body side wall connected to said curved side wall for enhancing directivity of acoustic waves in the chamber.

34. The instrument of claim 1 wherein a traditional instrument has a second body of a given chamber volume defined by a width and a length, said wave enhancing means comprises forming said first body with a configuration the same as said second body with at least one of the length and width greater than the second body width and length.

* * * * *